United States Patent [19]

Monson

[11] Patent Number: 4,692,959

[45] Date of Patent: Sep. 15, 1987

[54] ROTARY CLEANER/SCRUBBER MECHANISM

[76] Inventor: Clifford L. Monson, 1765 Ala Moana Blvd., Honolulu, Hi. 96815

[21] Appl. No.: 838,386

[22] Filed: Mar. 11, 1986

[51] Int. Cl.[4] ..... A47L 11/20

[52] U.S. Cl. ..... 15/320; 15/385

[58] Field of Search ..... 15/320, 321, 385

[56] References Cited

U.S. PATENT DOCUMENTS

| | | | |
|---|---|---|---|
| 4,182,001 | 1/1980 | Krause | 15/320 |
| 4,339,840 | 7/1982 | Monson | 15/320 X |
| 4,441,229 | 4/1984 | Monson | 15/320 X |

FOREIGN PATENT DOCUMENTS

| | | | |
|---|---|---|---|
| 576560 | 5/1933 | Fed. Rep. of Germany | 15/385 |

*Primary Examiner*—Chris K. Moore

*Attorney, Agent, or Firm*—Graybeal, Jensen & Puntigam

[57] ABSTRACT

A removable scrubbing head for use in carpet cleaners or the like including a rotatable vacuum plenum (26) having secured thereto a plurality of rotatable vacuum nozzles (28) such that the nozzles (28) rotate about their own axis while simultaneously rotation with the plenum. The interconnection between the plenum and the individual vacuum heads is such that only one needs to be driven to generate both rotations. Cleaning fluid and the vacuum source are provided through a hollow central shaft.

7 Claims, 9 Drawing Figures

FIG. 3
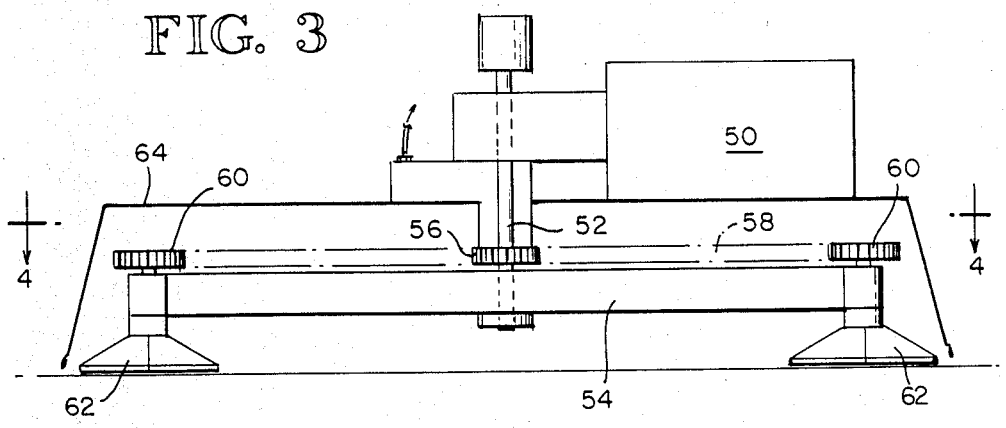
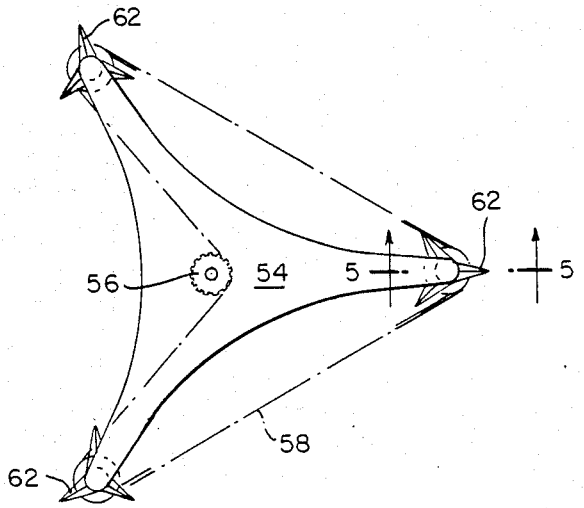
FIG. 4
FIG. 5
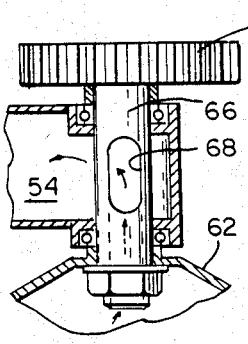
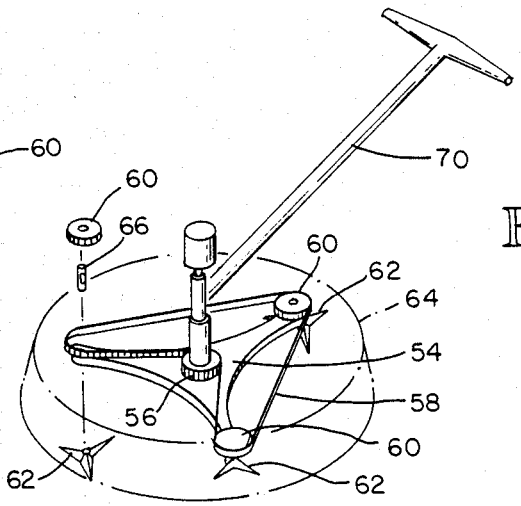
FIG. 6

ROTARY CLEANER/SCRUBBER MECHANISM

1. Technical Field

This invention relates to a cleaner/scrubber mechanism primrarily for use upon carpeting or the like and, more particularly, to a cleaner/polisher mechanism including a plurality of vacuum/scrubber nozzles mounted to a removable turn table or vacuum arm assembly. The plurality of vacuum/scrubber nozzles are rotatably secured to the underside of the turntable or vacuum arm assembly and are in communication with a common plenum which is in turn in communication with a vacuum source. The nozzles are rotating about their axis at a first speed whereas the turntable or vacuum arm assembly supporting the nozzles is rotating about its axis in the opposite direction and may well be rotating at a different speed. A device for spraying a liquid cleaner upon the flooring to be scrubbed is likewise rotating at possibly a third speed. The variance in direction and speed of rotation of the elements of the inventive scrubber/polisher extraction head results in a superior cleaning function.

2. Background Art

Surface cleaning and polishing machines are well known in the industry. In the past manufacturers have attempted to combine, mechanically and functionally, liquid spraying of a cleaning solution, scrubbing the surface and vacuuming the residue. The designers of these machines attempt to combine the various operations and the structure which performs these operations in a manner which makes the operation efficient while maintaining the other desirable aspects of low price, ease of use and manufacture and durability.

The prior art which best exemplifies the heretofore mentioned knowledge includes U.S. Pat. No. 4,182,001 granted to Krause, Jan. 8, 1980. This document discloses a cleaning and rinsing device incorporating vacuum heads and spray nozzles mounted to a turntable. The turntable is caused to rotate in the opposite direction of a plurality of rotating brushes mounted to the turntable. Krause provides a plurality of vacuum heads spaced between the brushes, secured to and rotating as a unit with the turntable.

Another device which illustrates the prior art includes U.S. Pat. No. 4,441,229 granted Apr. 10, 1984 to the present inventor. This cleaing device includes a rotary head and a plurality of nozzles fixedly secured to the rotary head which include means to accommodate minor differences in the angle of attack and support the device. The head carries both the spray and vacuum nozzles in the same circular path during operation.

Other cleaner/polishers which are less pertinent to the present invention but which do disclose the state of the art include U.S. Pat. No. 3,619,848 granted November 1971 to Salzman; U.S. Pat. No. 3,624,668 granted November 1971 to Krause; U.S. Pat. No. 4,000,538 granted January 1977 to Tissier; and U.S. Pat. No. 4,264,999 granted May 1981 to Monson, all of which were cited in the prosecution of U.S. Pat. No. 4,441,229 cited above.

With the above noted prior art in mind, it is an object of the present invention to provide a replaceable extraction head for a cleaner/polisher wherein each of the elements is rotatable at a predetermined rate and at least one of the elements in a different direction thereby constantly changing the interrelationship of the scrubbing elements and the fiber exposure thereby significantly increasing the efficiency of the scrubbing and extraction operation.

It is another object of the present invention to provide a vacuum scrubber/cleaner wherein the vacuum nozzles are individually rotatable while simultaneously being rotated as a group thereby providing a multidimensional scrubbing action contacting a greater portion of carpet fiber and resulting in a more thorough cleaning operation.

Still another object of the present invention is to provide a multi-faceted scrubber/cleaner head secured to the machine by a single securing means whereby the device is unitary and easily removed from the rest of the machine.

Still another object of the present invention is to provide a scrubber extractor assembly for use with a cleaning machine wherein the individual scrubber extractor heads are individually rotatably driven from a central drive hub.

3. Disclosure of the Invention

Accordingly, the present invention is a scrubber/polisher head for use on a rotary scrubber polishing machine wherein both the fluid to be applied to the surface and the vacuum for removing the dirt and dirty fluid from the surface utilize a hollow center driven shaft means as a conduit. The entire lower unit, or scrubber/polisher head, has unrestricted rotation and the major element is a turntable-type device to which the individual rotating nozzles are mounted whereby in one situation the spinning of the vacuum nozzles generates a torque which causes the turntable to rotate in the opposite direction at a different rate of speed and in a second situation having the turntable be driven and through reaction with a fixed element causing the nozzles to rotate. A third alternative incorporates a plurality of rigid radially outwardly extending vacuum arms terminating in individually rotatable vacuum heads. The spray applying nozzle may be rotated by direct drive from the driveshaft and could rotate at a speed different from the other rotating elements or could rotate as a unit with the vacuum assembly.

BRIEF DESCRIPTION OF THE DRAWINGS

FIG. 3 is a partially schematic vertical sectional view of an altrenate embodiment of the present invention.

FIG. 4 is a view along lines 4—4 of FIG. 3 with the shroud removed for clarity.

FIG. 5 is an enlarged section along lines 5—5 of FIG. 4.

FIG. 6 is a partially exploded isometric view of the embodiment of FIG. 3.

DETAILED DESCRIPTION OF THE DRAWINGS

Figure 1:
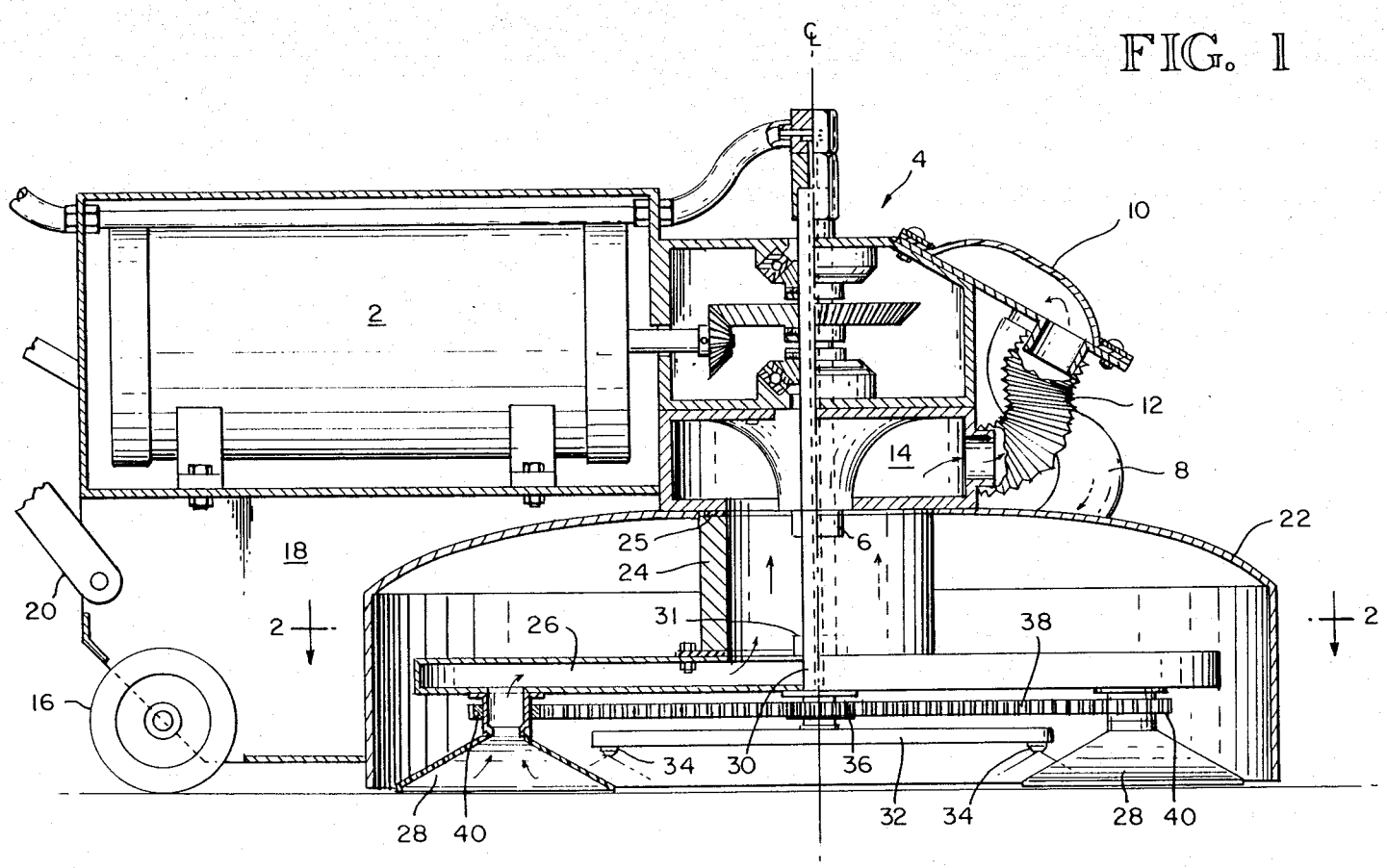
FIG. 1 is a vertical section through a typical environment for the inventive power scrubber vacuum head showing the interrelationship of the various elements.

As seen in FIG. 1, a floor scrubber is depicted upon which the inventive scrubber head would be appropriately used. In general terms, the scrubber includes a drive motor 2 which by means of gear box generally designated as 4 causes hollow driveshaft 6 to rotate. As explained hereinafter, driveshaft 6 generates all of the required motion for the operation of the various elements of the inventive scrubber head.

An external vacuum source interconnects via conduit 8 through a viewing chamber 10 and onduit 12 to a plenum area 14 which provides the necessary vacuum for removing the used cleaning fluid and suspended dirt when the device is in operation.

The other components of the floor scrubber polisher which make it functional but are not a part of the present invention include a set of wheels 16 mounted to a rigid body portion 18 to which is mounted a handle means 20 and a fixed shroud 22.

Figure 2:
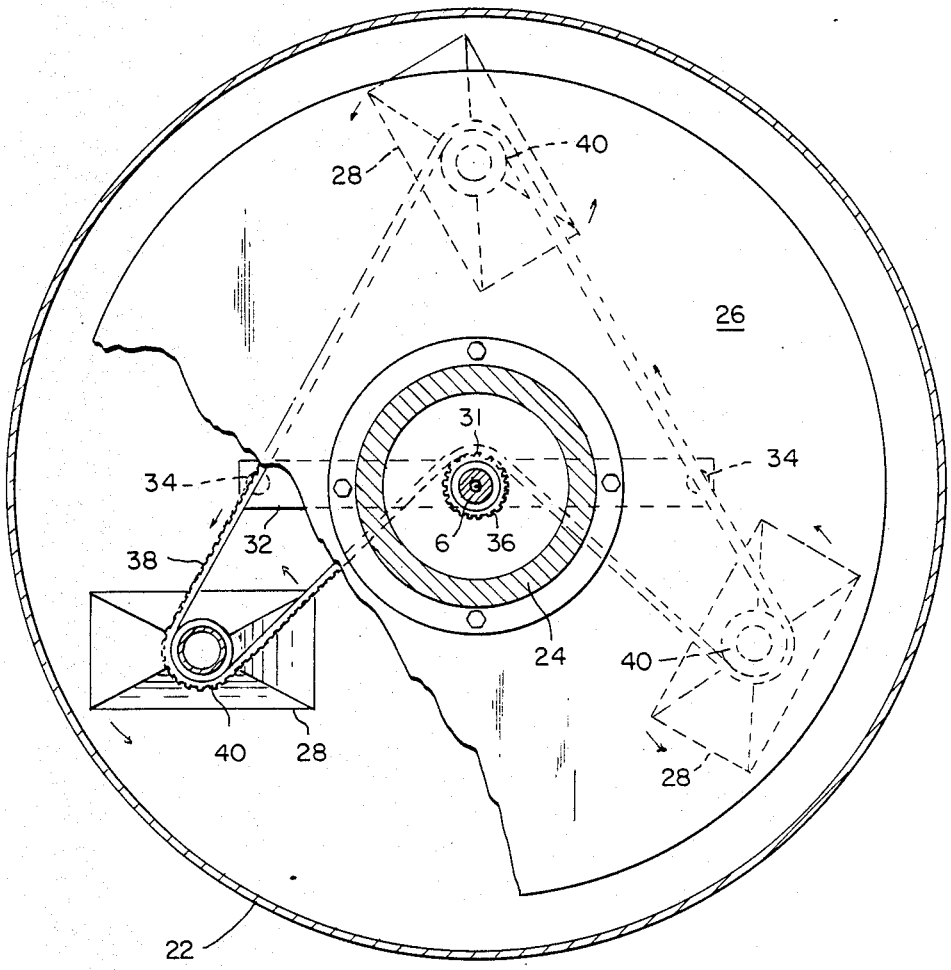
FIG. 2 is a horizontal section along lines 2—2 of FIG. 1 further illustrating the interrelationship of the various parts.

Also to be seen in this view, but described in greater detail with respect to FIG. 2, is the scrubber head which includes a hollow cylindrical, spacing/or filler member 24 which will vary in length to accommodate the machinery components and which serves as a conduit for the vacuum. Conduit 24 provides communication between the upper plenum 14 and the lower rotating plenum 26 which is in turn in fluid communication with a plurality of nozzles 28. Conduit 24 is fixedly secured to lower plenum 26 and includes a gasket 25 at the interface with the fixed housing 22.

Hollow drive shaft 6 has secured thereto, at threaded linking element 31, a removable driveshaft extension 30 which extends through the lowr plenum 26 and is in fluid communication with radially outwardly extending sprayer arms 32 which terminate in nozzles 34.

It is to be noted that in this embodiment, the sprayer arms 32 are directly connected to the lower driveshaft 30 and therefore rotate at the same speed. Intermediate the sprayer arms 32 and the lower plenum unit 26 is mounted a cog wheel 36 which drives belt 38 which in turn drives a cog wheel 40 on each of the vacuum nozzles 28 causing them to rotate about their axis. The rotary motion of the vacuum nozzles 28 generates a reactive torque which causes the plenum 26 to rotate about its axis in the opposite direction.

Referring now to FIG. 2, the interrelationship of the parts can more easily be seen since the left half portion of the turntable plenum 26 is broken away to show the mechanism mounted therebelow. To elaborate upon the general description given with respect to FIG. 1, it is to be noted that the hollow spacer conduit 24 which extends between the upper plenum 14 and the lower plenum 26 will be of a suitable length which may vary from machine to machine. The same variability as to length will be true with respect to the lower driveshaft 30 which is interconnected to upper hollow drive shaft 6 by means of a threaded interconnect element 31.

In operation, the fluid will be forced down through upper drive unit 6, lower drive unit 30 into the spray arms 32 and out nozzles 34 to apply the liquid to the surface at a predetermined rate. Simultaneously with the spraying of the cleaning fluid, lower drive unit 30 is driving cog wheel 36, belt 38 and cog wheels 40. The cog wheels are directly connected to each vacuum nozzle 28 causing them to rotate about their axis, providing a circular scrubbing motion. Note that the nozzle configuration where it contacts the surface is non-circular and preferably of a configuration having several nonaligned floor contacting surfaces. The configuration of the vacuum lip structure, i.e. where it contacts the floor will be a matter of design including the amount of floor contacting surface desired, the desired fluid flow and, of course, the cost of manufacture.

The rotation of the individual nozzles 28 generates a reverse torque which causes the lower plenum unit 26, to which the nozzles are mounted, to rotate about its axis in the opposite direction. Thus, as can be readily ascertained, the nozzles will be rotating in one direction about the axis which passes through driveshaft 6 and 30 while simultaneously rotating in the opposite direction around an axis which passes through the individual cog wheels 40 thus causing a multi-directional scrubbing action.

Simultaneously with the movement of the vacuum nozzles 28, the spray nozzles 34 are rapidly rotating, placing the fluid in the path of the vacuum nozzles to facilitate the scrubbing and cleaning of the carpet surface.

An alternative embodiment is disclosed in FIGS. 3–6 which is depicted somewhat schematically in FIG. 3 for clarity. The drive motor 50 causes the rotational movement of shaft 52 which is fixedly connected to lower plenum 54 which is driven thereby. Cog wheel 56 is rigidly secured to the framework of the scrubber/-cleaner and has interacting therewith a cog belt 58 which is also engaged with cog wheels 60 fixedly connected to nozzle members 62. Shroud 64 overlies the scrubbing mechanism.

In operation, the rotary movement of the plenum member 54 causes rotational movement of the nozzles 62 about the axis of plenum member 54 since they are carried thereby. The rotary movement of nozzles 62 with plenum 54, and having cog belt 58 interconnect cog wheels 56 and 60 causes the nozzles 62 to rotate about their own axis. As seen in FIG. 4, the plenum 54 could be of a triangular configuration having concave sides and the nozzle 62 could likewise be of a three pointed configuration to maximize their floor contact and improve their scrubbing efficiency.

Referring to FIG. 6, the operation of the nozzle 62 in conjunction with the plenum 54 can be seen. It is to be noted that the cog wheel 60 is fixedly secured to hollow shaft 66 appropriately mounted with bearings and having an opening at the bottom of the shaft in communication with the interior of the nozzle 62 and having at least one opening 68 through the side wall of the shaft within the hollow plenum area allowing continuous communication therewith. The number and size of the openings 68 will directly affect the efficiency of the mechanism. An alternate approach would utilize a central drive shaft with the vacuum conduit flowing adjacent thereto.

An exploded, slightly schematic, view of the entire mechanism is shown in FIG. 5 wherein the handle member 70 is depicted as the fixed portion to which the fixed cog wheel 56 is secured.

The remaining numbers used in this view and their related element are identical to those of Figure 3, 4 and 5 for convenience.

Figure 8:
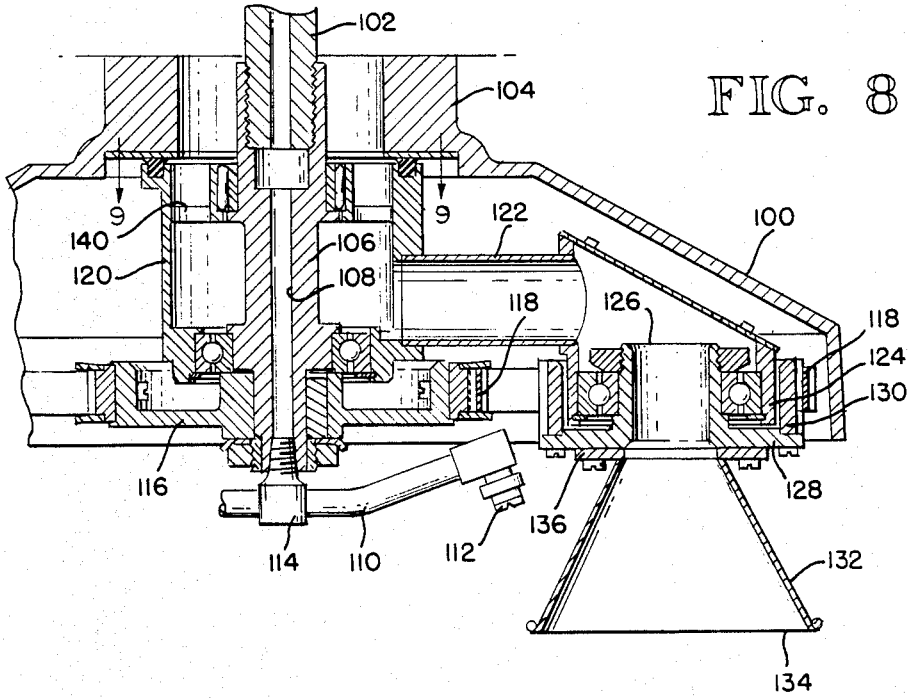
FIG. 8 is a partial sectional view taken along lines 8—8 of FIG. 7.
Figure 9:
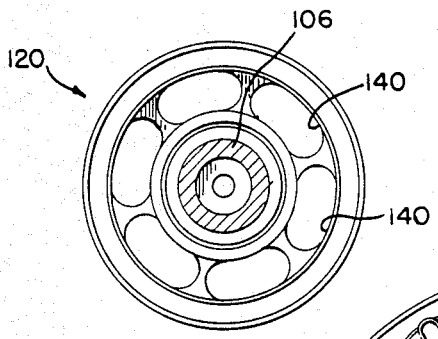
FIG. 9 is a partial sectional view taken along lines 9—9 of FIG. 8.
Figure 7:
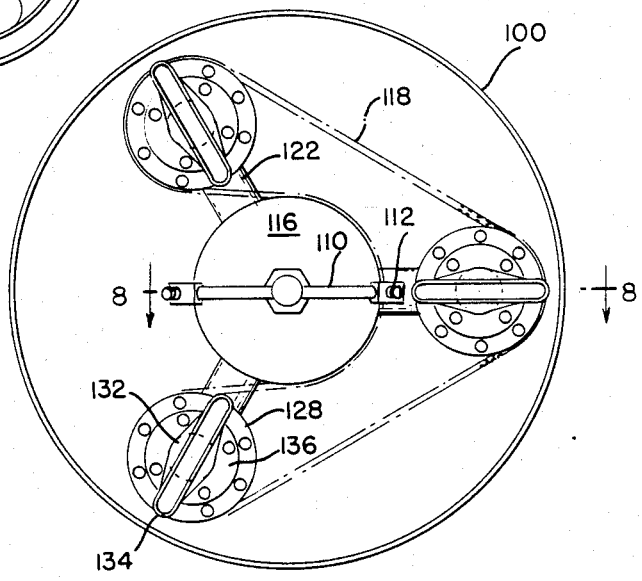
FIG. 7 is a bottom plan view of another embodiment of the present invention.

Yet another embodiment is disclosed in FIGS. 7 through 9 which incorporates the same principles including simultaneous rotation of the extraction nozzles and the extraction carrier unit.

As seen in FIG. 7, a central, driven pulley 116 utilizes belt 118 (phantom) to drive individual pulleys 130 which carry extraction nozzles 132. The relative size of the pulleys 130, 116 determines the relative rate of rotation and the torque developed causes the entire assembly to rotate.

Referring now to FIG. 8, an alternate embodiment may be seen wherein the shroud 100 again overlies the cleaning and scrubbing apparatus. In this embodiment, hollow drive shaft 102 extends downwardly through the center of the hub 104 of shroud 100 and has threadingly secured thereto drive element 106 including an axial bore 108 which allows the cleaning fluid to pass downwardly therethrough along outwardly extending arm members 110 to nozzle members 112. It is to be noted that the hub 114 to which the arms 110 are secured is threadingly engaged in the bottom portion of driveshaft 106 to allow quick release.

Likewise mounted to the bottom of the driveshaft 106 is drive pulley 116 which as described in greater detail hereinafter drives belt member 118. A hollow hub member 120 mounted for free rotation with respect to the driveshaft 106, and the hub 100 surrounds and encapsulates driveshaft 106. It is to be understood that appropriate bearings are incorporated. Mounted to, and extending from, hub member 120 are a plurality of hollow outwardly extending arm members 122 each having secured to the outer end thereof a downwardly projecting nipple member 124, circular in cross section. Hub member 126 has an upwardly projecting central portion terminating in a lower radially outwardly extending flange member 128 and has secured thereto an upwardly extending pulley member 130 in engagement with belt 118. Appropriate bearing means allow the hub member 126 to rotate with respect to number 124. Removably mounted to the bottom flange 128 of hub member 126 is a nozzle member 132 which as best seen in FIG. 7 has an elongated narrow lip portion 134 for contact with the supporting surface and a circular outwardly flaring upper flange member 136 for engagement with the flange 128.

In operation, a vacuum source is connected to the machine such that the air flow and entrapped elements enter the bottom of the nozzle 132 pass upwardly through the hub 126 radially inwardly through arms 122 into the interior of hub member 120 and upwardly through member 140, which as best seen in FIG. 9 includes a plurality of oblong openings 142 to allow the easy passage of the vacuumed material, and continues on to a collection site.

Thus as can be seen, the present invention contemplates an efficient scrubber/polisher for use upon carpeting or the like wherein the scrubbing action is caused by a combination of the rotation of the plenum and attached nozzles collectively defines as the vacuum assembly while simultaneously causing the nozzles themselves to rotate, possibly at a different speed, and in a different direction. The scrubbing mechanism is quickly and easily removed for repair or replacement.

What is claimed is:

1. A scrubbing head for use with a carpet cleaning machine or the like comprising:

a hollow vertical drive shaft adapted to be releasably secured to a driving means including a source of cleaning fluid, said drive shaft terminating at the lower end in a spray means for applying the cleaning fluid, a rotatable, horizontally mounted plenum, removably secured to a vacuum source, said plenum mounted for free rotation upon said drive shaft and including a plurality of downwardly facing ports, a vacuum nozzle rotatably secured to each port in fluid communication with the plenum, each of said nozzles including a drive means mounted thereon, means interconnecting the drive shaft and each of said vacuum nozzle drive means whereby the vacuum nozzles individually rotate while simultaneously moving with the plenum.

2. As an attachment for a floor cleaning machine, a vacuum head assembly comprising:

conduit means for attachment to a vacuum source, a plurality of vacuum heads operationally connected to said conduit, carrier means, supporting said vacuum heads, said carrier means including means for attaching said carrier means to the cleaning machine, means for rotating said carrier means, and for rotating said vacuum heads.

3. A vacuum head assembly as in claim 2 and further including means for applying a cleaning solution.

4. A vacuum head assembly as in claim 3 wherein the means for applying the cleaning solution comprises a separate wand rotating at a speed different from the carrier means.

5. A vacuum head assembly as in claim 2 wherein the conduit means is secured to the vacuum source at the axis of rotation of the carrier means.

6. A vacuum head for cleaning carpet or the like, comprising:

a hub including a central shaft portion extending axially outwardly in a first direction therefrom to be removably secured to a driven shaft and including a conduit for fluid interconnection with a vacuum source;

means to rotate the hub;

collection means in fluid communication with the conduit and extending radially outwardly therefrom;

a plurality of rotatable vacuum heads extending axially in the opposite direction from the central shaft portion and located radially outwardly therefrom adapted for contact with the surface to be cleaned, said vacuum heads in communication with the collection means; and means to rotate the vacuum heads whereby a point on the vacuum heads follows an epicyclic path.

7. A combination scrubber-extractor means comprising:

a plurality of open ended scrubber-extractor heads adapted for contact with the surface to be cleansed, each scrubber-extractor head in fluid communication with the vacuum source; means to rotate each scrubber-extractor head about an axis normal to the surface to be scrubbed, said axis extending through each head, and to rotate them as a set about a common axis thus generating epicyclic scrubbing action, means to apply a scrubbing medium to the surface to be scrubbed.

* * * * *